US005534195A

United States Patent [19]

Chapman et al.

[11] Patent Number: 5,534,195

[45] **Date of Patent: * Jul. 9, 1996**

[54] PROCESS FOR MAKING PARTICLES COMPRISING LACTAM BLEACH ACTIVATORS

[75] Inventors: Benjamin E. Chapman; Michael T. Creedon, both of Cincinnati, Ohio

[73] Assignee: The Procter & Gamble Co., Cincinnati, Ohio

[ * ] Notice: The term of this patent shall not extend beyond the expiration date of Pat. No. 5,534,196.

[21] Appl. No.: 350,087

[22] Filed: Nov. 29, 1994

Related U.S. Application Data

[63] Continuation-in-part of Ser. No. 178,374, Dec. 23, 1993, abandoned.

[51] Int. Cl.[6] ..... C11D 1/14; C11D 1/22; C11D 17/06; C11P 3/28

[52] U.S. Cl. ..... 510/444; 252/186.39; 252/186.25; 510/376

[58] Field of Search ..... 252/98, 186.3, 252/186.27, DIG. 2, DIG. 1, DIG. 7, 186.39, 186.31, 102, 174.13, 174, 186.26; 257/186.25, DIG. 4, 99, 554, 555, 556, 558, 559, 174.21, 174.14, 135, 524, 542, 544, 548, 186.26

[56] References Cited

U.S. PATENT DOCUMENTS

| | | | |
|---|---|---|---|
| 4,115,309 | 9/1978 | Krause et al. | 252/186 |
| 4,126,573 | 11/1978 | Johnston | 252/99 |
| 4,207,199 | 6/1980 | Perner et al. | 252/174.13 |
| 4,290,903 | 9/1981 | Macglip et al. | 252/91 |
| 4,321,157 | 3/1982 | Harris et al. | 252/174.25 |
| 4,399,049 | 8/1983 | Gray et al. | 252/91 |
| 4,422,950 | 12/1983 | Kemper et al. | 252/186.38 |
| 4,444,674 | 4/1984 | Gray | 252/95 |
| 4,486,327 | 12/1984 | Murphy et al. | 252/94 |
| 4,545,784 | 10/1985 | Sanderson | 8/107 |
| 4,547,305 | 10/1985 | Cornelissen et al. | 252/94 |
| 4,678,594 | 7/1987 | Parformak et al. | 252/186.31 |
| 4,726,908 | 2/1988 | Kruse et al. | 252/91 |
| 4,731,195 | 3/1988 | Olson | 252/174.23 |
| 4,853,143 | 8/1989 | Hardy et al. | 252/102 |
| 4,921,631 | 5/1990 | Gradwell et al. | 252/186.38 |
| 4,938,889 | 7/1990 | Wilsberg et al. | 252/102 |
| 5,015,408 | 5/1991 | Reuss | 252/99 |
| 5,112,514 | 5/1992 | Bolkan et al. | 252/99 |
| 5,211,874 | 5/1993 | Haendler et al. | 252/186.26 |
| 5,279,757 | 1/1994 | Gethoffer et al. | 252/95 |
| 5,334,324 | 8/1994 | Zeise et al. | 252/91 |
| 5,405,412 | 4/1995 | Willey et al. | 252/102 X |
| 5,405,413 | 4/1995 | Willey et al. | 252/102 X |
| 5,460,747 | 10/1995 | Gosselink et al. | 252/102 X |

FOREIGN PATENT DOCUMENTS

| | | | |
|---|---|---|---|
| 0122763 | 10/1984 | European Pat. Off. | C11D 3/39 |
| 0376360 | 11/1989 | European Pat. Off. | C11D 3/395 |
| 0468824 | 7/1991 | European Pat. Off. | C11D 11/00 |
| 0356700 | 7/1989 | Germany | C11D 3/39 |
| 4024759 | 6/1992 | Germany | C11D 17/00 |
| 1539444 | 6/1976 | United Kingdom | D06L 3/02 |
| WO92/13798 | 8/1992 | WIPO | C01B 15/00 |
| WO93/12067 | 6/1993 | WIPO | C07C 69/66 |

*Primary Examiner*—Douglas J. McGinty
*Attorney, Agent, or Firm*—Ken K. Patel; Jerry J. Yetter; Jacobus C. Rasser

[57] ABSTRACT

Liquid alkyl lactam bleach activators are intimately mixed with a water-soluble surfactant and a thickener to form a bleach activator particle with good solubility, which perhydrolyzes well, and which is non-sticky and free flowing. Optionally, but preferably, the particles will further comprise binders and filler materials. Novel activator compositions comprising polyhydroxy fatty acid amides plus lactam activators are disclosed.

10 Claims, 1 Drawing Sheet

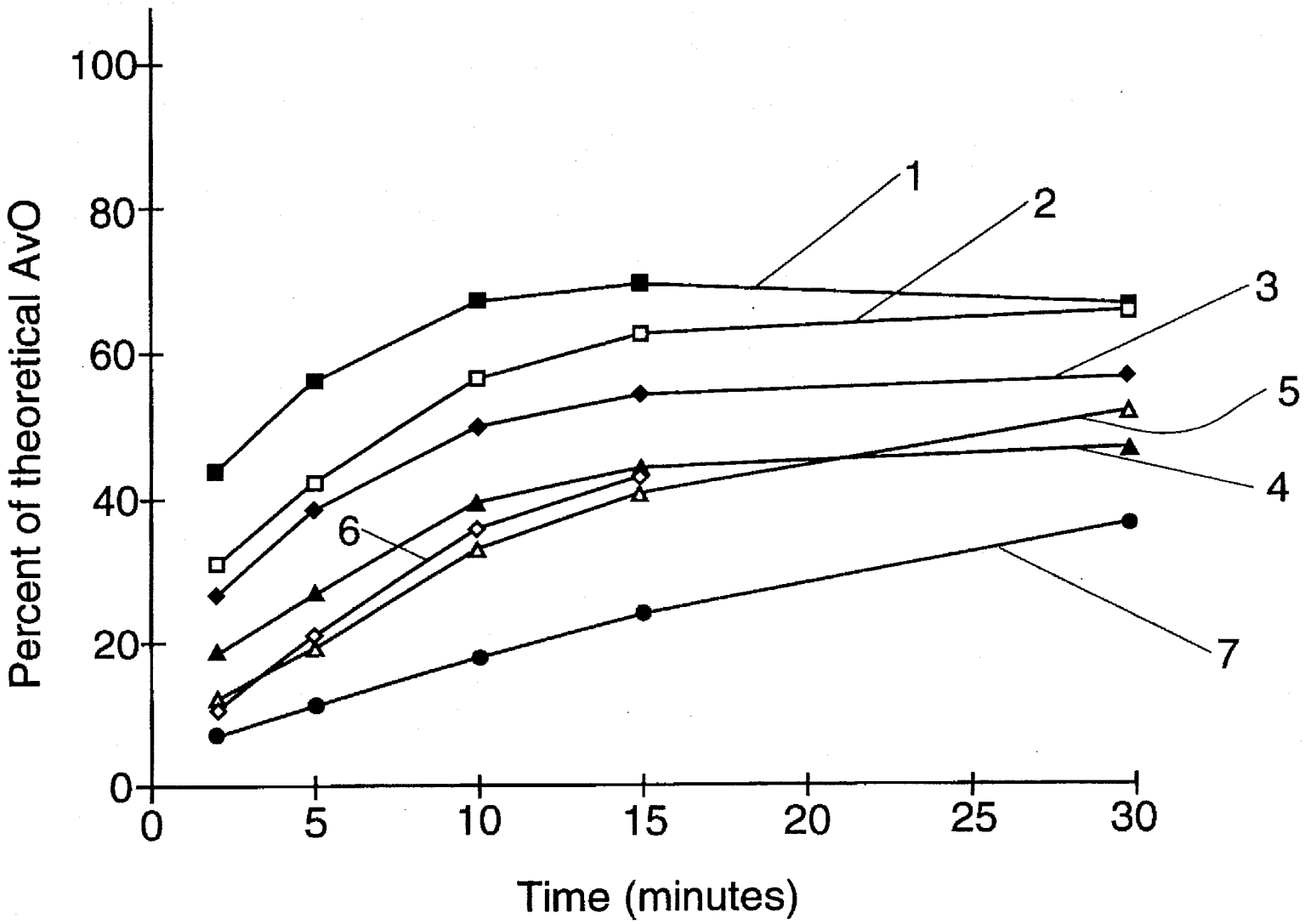
Percent of theoretical AvO
100
80
60
40
20
0
0
5
10
15
20
25
30
Time (minutes)
1
2
3
4
5
6
7

PROCESS FOR MAKING PARTICLES COMPRISING LACTAM BLEACH ACTIVATORS

CROSS-REFERENCE TO RELATED APPLICATION

This application is a continuation-in-part of application Ser. No. 08/178,374, filed Dec. 23, 1993.

TECHNICAL FIELD

This invention relates to processes for preparing particulate compositions containing a substantially water-insoluble liquid lactam bleach activator. The compositions herein are useful in detergents, bleaches, and the like.

BACKGROUND OF THE INVENTION

It is well known that peroxygen bleaches are effective for removing stains and/or soils, as well as visible evidence of stains and soils, from textiles and fabrics. Unlike sodium hypochlorite bleaching solution, they can be readily employed in a variety of bleaching and detergent compositions. However, the efficacy of peroxygen bleaches can vary greatly with temperature. These bleaches are only practicable and/or effective when the bleaching solution (bleach and water mixture) is above about 60° C. When employed in a bleach solution at a temperature of about 60° C., or below, peroxygen bleaches are significantly less efficacious than at higher temperatures. Therefore, to obtain a desirable level of bleaching performance at these lower temperatures, extremely high levels of peroxygen bleach must be employed. Due to the cost of peroxygen bleach compounds, levels necessary to achieve good bleaching performance at such temperatures are not economically attractive. In bleach solutions where the temperature is well below 60° C., peroxygen bleaches are rendered almost totally ineffective regardless of the level of peroxygen bleach compound added to the system.

The dependence of peroxygen bleach performance on temperature and concentration described above is both practically and economically significant. Peroxygen bleaches are most commonly used as detergent adjuvants in home laundry products. Thus, the typical textile wash process employing these bleaches uses an automatic household washing machine and a wash-water temperature below 60° C. Handwashing is conducted at even lower temperatures, typically less than about 35° C. As a consequence, there has been considerable interest in developing substances that would increase the efficacy of peroxygen bleach compounds, thereby allowing them to be employed at temperatures below 60° C. Such substances are generally referred to in the art as "bleach activators" or "peroxygen bleach activators".

Most of these prior art bleach activators are solids and are intended primarily as adjuncts to conventional laundry detergent granules. Such laundry granules typically comprise a solid bleach activator in admixture with a coating or carder material which serves to enhance the stability of the bleach activator and to facilitate its uniform dispersion in the granular detergent.

Different from the solid bleach activators known heretofore, one class of bleach activators which have now been found to provide good bleaching of textiles lo and fabrics, especially on hydrophobic stains, comprise the liquid acyl lactam bleach activators, such as octanoyl caprolactam, octanoyl valerolactam, nonanoyl caprolactam and nonanoyl valerolactam. However, such substantially water-insoluble liquid lactam bleach activators can be difficult to use in granular laundry detergent compositions because they are liquids at ambient temperatures and tend not to solubilize/disperse satisfactorily in the wash water. Indeed, the unsolubilized liquid bleach activators can separate from the wash liquor as an oily liquid and fail to be converted to peracids, or can even ultimately cling to the fabrics in the wash where they react with the peroxygen bleach and spot or remove color from the fabrics.

According to the practice of the present invention, a surfactant intimately mixed with the liquid bleach activator would seem to solve the solubility/dispersibility problems. However, the liquid activators also need to be converted into a solid form which can be incorporated into granular detergent compositions. Because of the problems associated with converting a liquid bleach activator to a solid particle, the choice of a suitable surfactant is limited. It has now also been discovered that certain preferred surfactants help to thicken the liquid bleach activators into a non-sticky mass which can then be formed into particles while avoiding the tendency of the particles to "cake". Preferred surfactants and mixtures of surfactants have now also been found which provide good solubility of the otherwise poorly soluble activator once the particle is introduced into the wash liquor.

Accordingly, the present invention resolves the problems of utilizing liquid acyl lactam bleach activators in granule form by providing a stable matrix of materials in a particulate form that has satisfactory solution/dispersibility characteristics. The invention also provides non-sticky, free flowing bleach activator particles which are stable on storage even at temperatures of 50°–55° C., and higher. These and other advantages are provided by the instant invention, as will be seen from the following disclosure.

BACKGROUND ART

U.S. Pat. No. 4,545,784, Sanderson, issued Oct. 8, 1985, discloses the adsorption of activators onto sodium perborate monohydrate.

U.S. Pat. No. 4,290,903, Macgilp, et al., issued Sep. 22, 1981, discloses a process for preparing granular bleach activator products. See also U.S. Pat. 4,444,674, Gray, issued Apr. 24, 1984, and U.S. Pat. No. 4,399,049, Gray et al., issued Aug. 16, 1983, and DE 4,024,759, Zeise et al., issued Feb. 6, 1992.

SUMMARY OF THE INVENTION

The present invention encompasses a process for preparing particulate particles containing a substantially water-insoluble liquid bleach activator compound, including but not limited to lactam activators, or mixtures of such compounds. The invention also encompasses preferred particulate bleach activator compositions comprising:

(a) a liquid bleach activator;

(b) a thickener or thickener surfactant, especially a polyhydroxy fatty acid amide; preferably at a weight ratio of component (a):component (b) in the range of from about 1:5 to about 5:1;

(c) optionally, but preferably, a particulate filler; and (d) optionally, but preferably, a non-amide solubilizing surfactant.

Highly preferred compositions herein are those wherein the liquid activator is a caprolactam or valerolactam activator, and especially wherein the polyhydroxy fatty acid amide is a $C_{12}$–$C_{18}$ N-methylglucamide. Such particles will also preferably comprise a particulate carrier. Any compatible particulate material can be used, for example, water-soluble phosphates, carbonates, sulfates, as well as water-insoluble carriers such as zeolites, silicates, clays such as bentonite and the like. The nonamide solubilizing surfactant used in the preferred particles is preferably a member selected from the group consisting of anionic and nonionic detersive surfactants, especially a member selected from the group consisting of alkyl sulfate surfactants, sulfonated fatty acid ester (MES) surfactants, alkyl ethoxylate surfactants and mixtures thereof.

The particles herein can additionally comprise a binder and can be substantially coated with a free-flow agent.

Preferred particulate bleach activator particles made according to this process comprise:

(1) from about 10 to about 70% by weight and preferably from about 20 to about 60% by weight of one or more, liquid lactam bleach activators;

(2) from about 1 to about 60% by weight and preferably from about 2 to about 50% by weight of one or more non-thickener surfactants; and (3) from about 5 to about 60% by weight and preferably from about 10 to about 50% by weight of one or more thickeners (or thickener surfactants).

Optionally, they also may comprise:

(4) from about 10 to about 85% by weight and preferably from about 15 to about 80% by weight of filler material.

(5) from about 5 to about 25% by weight and preferably from about 10 to about 25% by weight of binder material.

In its process mode, the present invention encompasses an aqueous process for preparing a particulate bleach activator composition, comprising the steps of:

(I) intimately mixing a liquid lactam bleach activator with a member selected from the group consisting of non-amide surfactants, polyhydroxy fatty acid amide thickener surfactants, non-surfactant thickeners, or mixtures thereof, to provide a thickened paste having a free moisture content above about 15%, by weight;

(II) homogenizing the paste of step I with a hydratable filler material to provide a semi-particulate mass or damp powder; and (III) forming the product of step II into agglomerates having a free moisture content less than about 8%, by weight, of water.

Liquid lactams preferred for use herein include members selected from the group comprising hexanoyl caprolactam, hexanoyl valerolactam, octanoyl caprolactam, octanoyl valerolactam, nonanoyl caprolactam, nonanoyl valerolactam, isononanoyl caprolactam, isononanoyl valerolactam, decanoyl caprolactam, decanoyl valerolactam, undecanoyl caprolactam, undecanoyl valerolactam, 3,5,5-trimethylhexanoyl caprolactam, 3,5,5-trimethylhexanoyl valerolactam and mixtures thereof.

Non-amide surfactants preferred for use herein include members selected from the group consisting of sodium $C_{11}$–$C_{13}$ linear alkylbenzene sulfonates, $C_{12}$–$C_{16}$ alkyl sulfates, $C_{14}$–$C_{18}$ methyl ester sulfonates, $C_{10}$–$C_{18}$ polyethylene oxide condensates of alkyl moieties with an average of about 50 to 100 ethylene oxide groups, and mixtures thereof.

Non-surfactant thickeners preferred for use herein include members selected from the group consisting of polyethylene glycols, magnesium compounds, polyvinyl-pyrrolidone, ethyl cellulose, sodium alumino-silicate, and solid acyl lactams.

Preferred polyhydroxy fatty acid amide thickener surfactants herein comprise the $C_{12}$–$C_{18}$ N-methylglucamides.

Suitable and preferred filler materials for use herein comprise members selected from the group consisting of zeolite A, sodium carbonate, sodium sulfate, sodium acetate, sodium phosphate, sodium acid phosphite, lithium formate, lithium sulfate, zinc nitrate, sodium carbonate, zeolite A, and mixtures thereof.

In an alternate mode, the process herein additionally comprises the addition of a binder material selected from the group consisting of polyethylene glycols, fatty acids, film forming polymers, and mixtures thereof during Step I or Step II.

In yet another mode, the invention herein provides a non-aqueous process for preparing a particulate bleach activator composition, comprising the steps of:

(I) intimately mixing a liquid lactam bleach activator with a member selected from the group consisting of non-amide surfactants, polyhydroxy fatty acid amide thickener surfactants, non-surfactant thickeners, and mixtures thereof, to form a thickened paste having a moisture content less than about 15%, by weight;

(II) optionally, homogenizing the paste of step I with a filler material; and (III) forming the product of step II into agglomerates having a free moisture content less than about 6%, by weight, of water.

In the non-aqueous process, the selection of preferred ingredients may be made from the above noted listings.

All percentages, ratios and proportions herein are by weight, unless otherwise specified. All documents cited are, in relevant part, incorporated herein by reference.

BRIEF DESCRIPTION OF THE DRAWINGS

FIG. 1 depicts a family of curves which demonstrate bleaching activity, given as percent of theoretical AvO versus time. The tests were run under European washing conditions (40° C.; pH 10.6; 1:1 Wt. ratio of N-octanoyl caprolactam:perborate monohydrate). Test data are for 350 ppm octanoyl caprolactam and 8,000 ppm of a typical granular detergent composition. Curve 1 shows the activity of the octanoyl caprolactam pre-dissolved in dimethyl formamide. This curve demonstrates the maximum expected AvO generation profile. Curve 2 shows the octanoyl caprolactam used in combination with a polyhydroxy fatty acid amide and sulfonated fatty acid surfactant (MES) with a solid zeolite A carrier. Curve 3 shows the octanoyl caprolactam in combination with the polyhydroxy fatty acid amide surfactant plus an alkyl sulfate surfactant with the zeolite A carrier. Curve 4 shows octanoyl caprolactam, polyhydroxy fatty acid amide, MES anionic surfactant and zeolite 13X carrier. Curve 5 shows octanoyl caprolactam and zeolite A. Curve 6 shows octahoyl caprolactam, polyhydroxy fatty acid amide, conventional alkyl ethoxylate nonionic surfactant, zeolite A and sodium carbonate carrier. Curve 7 shows the octanoyl caprolactam with the zeolite 13X carrier, without surfactant.

DETAILED DESCRIPTION OF THE INVENTION

The process of the present invention can be conducted in either of two modes, referred to herein as "aqueous" and "non-aqueous", for preparing particulate particles containing one or more substantially water-insoluble liquid acyl lactam bleach activator compounds. The aqueous process described herein is defined as a process in which a surfactant paste (i.e., water content from about 10% to about 50% by weight) is mixed with a liquid acyl lactam bleach activator, a thickener, a hydratable filler material and optionally a binder. In a preferred aqueous process, use of the binder results in optimal particle formation. The non-aqueous process described herein is defined as a process in which a substantially dry surfactant (i.e., water content from about 0% up to about 10% by weight) is mixed with a liquid acyl lactam bleach activator, a thickener, filler material and optionally a binder. In a preferred non-aqueous process, the binder is added for optimal particle formation. The aqueous and non-aqueous processes employ respective Mixing Steps I and II and Particle Forming Step III, all as described hereinafter.

Acyl Lactam Bleach Activator

The processes of the present invention employ mixtures of ingredients comprising from about 10 to about 70% by weight, preferably from about 20 to about 60% by weight, most preferably from 25 to 50, % by weight of substantially water-insoluble liquid acyl lactam bleach activators. The preferred ratio of bleach activator to surfactant in Mixing Step I is between about 50:1 and about 1:2, preferably between about 25:1 and about 1:1, most preferably between about 10:1 to about 1:1.

The preferred acyl lactam bleach activators are liquids at ambient temperatures (i.e., have melting points at temperatures of about 25° C. and below). Suitable caprolactam bleach activators are of the formula:

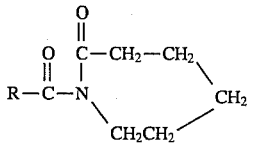

wherein R is an alkyl or alkenyl group containing from about 6 to about 12 carbons. Examples of preferred alkyl caprolactam activators include hexanoyl caprolactam, octanoyl caprolactam, nonanoyl caprolactam, isononanoyl caprolactam, decanoyl caprolactam, undecenoyl caprolactam, 3,5,5-trimethylhexanoyl caprolactam, and mixtures thereof.

Suitable valerolactam bleach activators are of the formula:

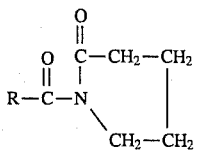

wherein R is an alkyl or alkenyl group containing from about 6 to about 12 carbons. Examples of preferred acyl valerolactam activators include hexanoyl valerolactam, octanoyl valerolactam, nonanoyl valerolactam, isononanoyl valerolactam, decanoyl valerolactam, undecenoyl valerolactam, 3,5,5-trimethylhexanoyl valerolactam, and mixtures thereof. Especially preferred are the valerolactams selected from the group consisting of octanoyl valerolactam, nonanoyl valerolactam, isononanoyl valerolactam, and mixtures thereof.

Methods for making lactams are well known in the art. Examples I and II, included below, illustrate preferred laboratory syntheses.

Contrary to the teachings of U.S. Pat. No. 4,545,784, cited above, caprolactam bleach activators are preferably not adsorbed directly onto the peroxygen bleaching compound. To do so in the presence of other organic detersive ingredients could cause premature perhydrolysis, loss of activity, and even safety problems. However, other agents for storage stabilization or exotherm control can be added to the bleach activator before incorporation into the final product. For example, buffering agents and chelants can optionally be included.

Bleach Activator-Stable Non-Surfactant Thickeners

The particulate particles of this invention include from about 5 to about 60% by weight, preferably from about 10 to about 50% by weight, and most preferably from about 15 to about 50% by weight of thickeners selected from the group consisting of polyhydroxy fatty acid amides which are most preferred; polyethylene glycols, especially polyethylene glycols with molecular weights of between 4,000 and 8,000; magnesium compounds, including magnesium stearate and magnesium chloride; polyvinylpyrrolidone; ethyl cellulose; sodium alumino-silicate; solid acyl lactams, such as benzoyl caprolactam, substituted benzoyl caprolactam, benzoyl valerolactam, substituted benzoyl valerolactams; and mixtures thereof. Other thickeners include high molecular weight, highly ethoxylated nonionics such as the tallow 50 mole ethoxylates (GENEPOL T500) and $C_{12}$–$C_{15}$ 50–100 mole ethoxylates (NEODOL 25–50 and 25–100). The thickener may be added as a solid or as a deformable paste comprising thickener and water (approximately 1:1 ratio). By "deformable paste" (as used hereinafter) is meant a mobile pasty mass whose shape can be altered or changed by exerting a shear force to the mass (usually by hand pressure) and has a consistency similar to solid Crisco® shortening or PlaydoughT. From about 10 to about 50% by weight of thickener is preferred and from about 15 to about 50% by weight is most preferred.

Examples of suitable substituted benzoyl caprolactams and substituted benzoyl valerolactams used as thickeners include 4-chlorobenzoyl caprolactam, 4-nitrobenzoyl caprolactam, 3,3,5-trimethylbenzoyl caprolactam, 2,4-dinitrobenzoyl caprolactam, 4-chlorobenzoyl valerolactam, 4-nitrobenzoyl valerolactam, 3,4,5-trimethylbenzoyl valerolactam, 2,4-dinitrobenzoyl valerolactam, and mixtures thereof. These lactam compounds are especially desirable as thickeners because they also perhydrolyze and provide additional hydrophilic bleaching activity potentially on different bleach sensitive stains.

Bleach Activator-Stable Detergent Surfactant

The particulate particles of this invention also include from about 1 to about 60% by weight of bleach activator-stable, water-soluble detergent surfactant selected from the group consisting of anionics, nonionics, zwitterionics, ampholytics, and mixtures thereof. From about 2 to about 50% by weight of detergent surfactant is preferred and from about 5 to about 30% by weight is most preferred. Preferred anionic surfactants are preferred and salts of $C_{11}$–$C_{13}$ linear alkyl benzene sulfonates, $C_{12}$–$C_{18}$ primary alkyl sulfates (AS), $C_{12}$–$C_{18}$ secondary alkyl sulfates, $C_{14}$–$C_{18}$ methyl ester sulfonates, polyhydroxy fatty acid amides, and mixtures thereof. Combinations of polyhydroxy fatty acid amide surfactants with other preferred anionic surfactants are most preferred. The surfactant may be added as a solid or as a deformable paste. Less preferably, the surfactant may be a mixture comprising surfactant and water (approximately 1:1 ratio).

Nonlimiting examples of other surfactants useful herein include the conventional $C_{10}$–$C_{20}$ soaps; the $C_{12}$–$C_{18}$, preferably the $C_{12}$–$C_{16}$ primary and secondary alkyl sulfates and $C_{12}$–$C_{18}$ unsaturated (alkenyl) sulfates such as oleyl sulfate; the branched-chain $C_{10}$–$C_{18}$ alkyl sulfates; the $C_{10}$–$C_{18}$ alkyl ethoxy sulfates; the $C_{10}$–$C_{18}$ alkyl polyglycosides and their corresponding sulfated polyglycosides; the $C_{10}$–$C_{18}$ polyhydroxy fatty acid amides, especially the $C_{10}$–$C_{18}$ fatty acid amides of N-methyl through N-hexyl glucamine, see WO 9,206,154 and 9,206,984; $C_{14}$–$C_{18}$ alkyl methyl ester sulfonates (a-sulfonated fatty acid methyl esters; MES); the $C_{10}$–$C_{18}$ alkyl ethoxy carboxylates; and oleoyl sarcosinate. The following are representative examples of detergent surfactants useful in the present compositions.

Water-soluble salts of the higher fatty acids, i.e., "soaps", are useful anionic surfactants in the compositions herein. This includes alkali metal soaps such as the sodium, potassium, ammonium, and alkylammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkanolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11}$–$C_{13}$ LAS.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Suitable nonionics are the water-soluble and water-dispersible condensation products of aliphatic alcohol's containing from 8 to 22 carbon atoms, in either straight chain or branched configuration, with from 25 to 100 moles of ethylene oxide per mole of alcohol. Particularly preferred are the condensation products of alcohols having an alkyl group containing from about 9 to 15 carbon atoms with about 50 moles of ethylene oxide per mole of alcohol. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Examples of preferred surfactants include salts of linear alkyl benzene sulfonates, especially sodium $C_{11}$–$C_{13}$ linear alkyl benzene sulfonate; salts of methyl ester sulfonates (MES), especially $C_{14}$–$C_{18}$ methyl ester sulfonates; polyhydroxy fatty acid amides; alkyl sulfates, especially $C_{12}$–$C_{16}$ alkyl sulfates; $C_{10}$–$C_{18}$ polyethylene oxide condensates of alkyl moieties with an average of about 50 to 100 ethoxylate groups, and mixtures thereof. In an especially preferred process, a polyhydroxy fatty acid amide is used as both a thickener and as a secondary surfactant, and co-acting with an anionic surfactant serving as the primary solubilizing surface active agent.

Polyhydroxy Fatty Acid Amide Thickener Surfactants

Surprisingly, it has been discovered that polyhydroxy fatty acid amides serve not only as surfactants herein, but also provide a thickener effect. Accordingly, such "thickener surfactants" are preferred for use herein. In a most preferred process, this thickener surfactant is mixed with an anionic surfactant or mixtures thereof.

The N-alkoxy, N-aryloxy polyhydroxy fatty acid amides used herein comprise materials of the formula:

$$R^3-\overset{\overset{\displaystyle O}{\|}}{C}-\overset{\overset{\displaystyle R^1-O-R^2}{|}}{N}-Z \qquad \text{(I)}$$

The N-alkyl polyhydroxy fatty acid amides used herein comprise materials of the formula:

$$R^3-\overset{\overset{\displaystyle O}{\|}}{C}-\overset{\overset{\displaystyle R^4}{|}}{N}-Z \qquad \text{(II)}$$

wherein in formulas (I) and (II): $R^3$ is $C_7$–$C_{21}$ hydrocarbyl, preferably $C_9$–$C_{17}$ hydrocarbyl, including straight-chain and branched-chain alkyl and alkenyl, or mixtures thereof; $R^1$ is $C_2$–$C_8$ hydrocarbyl including straight-chain, branched-chain and cyclic (including aryl), and is preferably $C_2$–$C_4$ alkylene, i.e., $—CH_2CH_2—$, $—CH_2CH_2CH_2—$ and $—CH_2(CH_2)_2CH_2—$; $R^2$ is $C_1$–$C_8$ straight-chain, branched-chain and cyclic hydrocarbyl including aryl and oxy-hydrocarbyl, and is preferably $C_1$–$C_4$ alkyl or phenyl; $R^4$ is $C_1$–$C_6$ alkyl or hydroxyalkyl, including methyl (preferred), ethyl, propyl, isopropyl, butyl, pentyl, hexyl, 2-hydroxyethyl, 3-hydroxypropyl, and the like; and Z is a polyhydroxyhydrocarbyl moiety having a linear hydrocarbyl chain with at least 2 (in the case of glyceraldehyde) or at least 3 hydroxyls (in the case of other reducing sugars) directly connected to the chain, or an alkoxylated derivative (preferably ethoxylated or propoxylated) thereof. Z preferably will be derived from a reducing sugar in a reductive amination reaction; more preferably Z is a glycityl moiety. Suitable reducing sugars include glucose, fructose, maltose, lactose, galactose, mannose, and xylose, as well as glyceraldehyde. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 1 to 5, inclusive, and R' is H or a cyclic mono- or polysaccharide, and alkoxylated derivatives thereof. Most preferred are glycityls wherein n is 4, particularly $—CH_2—(CHOH)_4—CH_2OH$.

In compounds of the above formula (I), nonlimiting examples of the amine substituent group $—R^1—O—R^2$ can be, for example: 2-methoxyethyl-, 3-methoxypropyl-, 4-methoxybutyl-, 5-methoxypentyl-, 6-methoxyhexyl-, 2-ethoxyethyl-, 3-ethoxypropyl-, 2-methoxypropyl, methoxybenzyl-, 2-isopropoxyethyl-, 3-isopropoxypropyl-, 2-(t-butoxy)ethyl-, 3-(t-butoxy)propyl-, 2-(isobutoxy)ethyl-, 3-(isobutoxy)propyl-, 3-butoxypropyl, 2-butoxyethyl, 2-phenoxyethyl-, methoxycyclohexyl-, methoxycyclohexylmethyl-, tetrahydrofurfuryl-, tetrahydropyranoxyethyl-, 3-[2-methoxyethoxy]propyl-, 2-[2-methoxyethoxy]ethyl, 3-[3-methoxypropoxy]propyl-, 2-[3-methoxypropoxy]ethyl-, 3-[methoxypolyethylene-oxy]propyl-, 3-[4-methoxybutoxy]propyl- 3-[2-methoxyisopropoxy]propyl, $CH_3O—CH_2CH(CH_3)—$ and $CH_3OCH_2CH(CH_3)CH_2—O—(CH_2)_3—$.

R—CO—N< can be, for example, cocamide, stearamide, oleamide, lauramide, myristamide, capricamide, palmitamide, tallowamide, etc.

While the synthesis of N-alkoxy, N-aryloxy or N-alkyl, alkenyl and hydroxyalkyl polyhydroxy fatty acid amides can prospectively be conducted using various processes, contamination with cyclized by-products and other colored materials may be problematic. As an overall proposition, the synthesis method for these surfactants can comprise reacting the appropriate N-substituted aminopolyols with fatty acid methyl esters or fatty acid glycerides with or without a solvent, but preferably using methanol or an ethoxylated alcohol such as NEODOL as a solvent, using an alkoxide catalyst at temperatures of about 85° C. to provide high yields (90%-98%) of the products having desirable low levels (preferably, less than about 10%) of ester amide or cyclized by-products and also with improved color and improved color stability, e.g., Gardner Colors below about 4, preferably between 0 and 2. See, for example, U.S. Pat. No. 5,194,639 to Connor, Scheibel and Severson, issued Mar. 16, 1993. If desired, any unreacted amino polyol remaining in the product can be acylated with an acid anhydride, e.g., acetic anhydride, maleic anhydride, or the like, in water at 50° C.–85° C. to minimize the overall level of such residual amines in the product. Residual sources of straight-chain primary fatty acids, which can suppress suds, can be depleted by reaction with, for example, monoethanolamine at 50° C.– 85° C.

If desired, the water solubility of the solid N-alkoxy polyhydroxy fatty acid amide surfactants herein can be enhanced by quick cooling from a melt. While not intending to be limited by theory, it appears that such quick cooling re-solidifies the melt into a metastable solid which is more soluble in water than the pure crystalline form of the N-alkoxy polyhydroxy fatty acid amide. Such quick cooling can be accomplished by any convenient means, such as by use of chilled (0° C.–10° C.) rollers, by casting the melt onto a chilled surface such as a chilled steel plate, by means of refrigerant coils immersed in the melt, or the like.

By "cyclized by-products" herein is meant the undesirable reaction by-products of the primary reaction wherein it appears that the multiple hydroxyl groups in the polyhydroxy fatty acid amides can form ring structures. It will be appreciated by those skilled in the chemical arts that the preparation of the polyhydroxy fatty acid amides herein using the di- and higher saccharides such as maltose will result in the formation of polyhydroxy fatty acid amides wherein linear substituent Z (which contains multiple hydroxy substituents) is naturally "capped" by a polyhydroxy ring structure. Such materials are not cyclized by-products, as defined herein.

Particulate Filler Material

The purpose of the solid optional, but highly preferably filler material is to provide a solid "base" for the particles and also to diminish the free water level, if present, of the product of Step I or Step II to a desired level for good particle formation. The filler also improves finished particle handling characteristics and helps to achieve a desirable bleach activator concentration in the product. This filler material can be divided into "hydratable" and "non-hydratable" materials. Hydratable as used herein shall mean a "free" water absorbing material. Non-hydratable as used herein shall mean a non-absorbing "free" water material. By "free" water it is meant water contained within the composition that is not intimately bound to any of the components. The hydratable material is preferably not a film-forming material. Suitable non-hydratable materials include finely divided clays, including Bentonite, and alumino-silicates and/or crystalline surfactants. Such filler materials are known in the art. Suitable hydratable materials preferably have a pH between about 5.0–8.0, to most preferably between about 6.0–7.0. These are preferably selected from the group consisting of sodium sulfate, sodium acetate, sodium phosphate, sodium tripolyphosphate, sodium acid phosphite, lithium formate, lithium sulfate, zinc nitrate, and combinations thereof. Highly preferred is sodium sulfate. Materials to be avoided are halides and compounds containing heavy metals such as iron.

The approximate hydration temperatures of some of these materials are given below:

| | | |
|---|---|---|
| Sodium acetate | 136° F. | (58° C.) |
| Sodium phosphate | 94° F. | (35° C.) |
| Sodium acid phosphite | 108° F. | (42° C.) |
| Sodium sulfate | 90° F. | (32° C.) |

These filler materials are useful in processing the bleach activator-containing particles of this invention, and they add integrity to the final granule. The bleach activator-particles herein preferably comprise from about 10% to about 85% by weight, more preferably from about 15% to about 80% by weight, filler material.

Optional Bleach Activator-Stable, Water-Soluble Binders

The bleach activator particles of this invention can optionally comprise bleach activator-stable, water-soluble binders. The materials that can be utilized as binders are polyethylene glycols, fatty acids, film forming polymers, certain nonionic surfactants, and mixtures of these materials. Such binders should not be reactive with the bleach activators of the present invention. If the particles are placed in a detergent composition, the binder should not be reactive with the components of the detergent composition. Ideal binder materials have a low hygroscopicity upon storage but should be soluble or dispersible in water. This allows for dispersion and release of the bleach activator in the bleach or wash solution. It is also essential that the employed binder materials do not melt below about 50°–55° C. to avoid storage stability problems. Any melting of the binder during storage results in the particles becoming sticky and unhandleable.

The binder can be mixed with the bleach activator, thickener, and surfactant during Mixing Step I or in Mixing Step II. In preferred aqueous or non-aqueous embodiments, the binder is added in either Mixing Step I or Mixing Step II. The binder can be added as a hot melt or in an aqueous mixture. If added in an aqueous process, the binder can be mixed with water adding to the surfactant/bleach activator mixture.

Examples of suitable nonionic surfactants that can be utilized as binder materials are the polyethylene oxide condensates of alkyl phenols or aliphatic alcohols. These include the condensation products having an alkyl group containing from 8 to 22 carbon atoms with ethylene oxide.

Suitable polyethylene glycols which provide both a binding and thickening function are homopolymers of ethylene oxide having the general formula $HO(C_2H_4O)_nH$, having an average molecular weight of from about 2,000 to about 15,000, preferably from about 4,000 to about 8,000.

Suitable film forming polymers useful as binder materials in the particles of the present invention are the polymers derived from the monomers such as vinyl chloride, vinyl alcohol, furan, acrylonitrile, vinyl acetate, methyl acrylate, methyl methacrylate, styrene, vinyl methyl ether, vinyl ethyl ether, vinyl propyl ether, acrylamide, ethylene, propylene and 3-butenoic acid.

Preferred polymers of the above group are the homopolymers and copolymers of acrylic acid, hydroxyacrylic acid, or methacrylic acid, which in the case of the copolymers contain at least about 50%, and preferably at least about 80%, by weight, units derived from the acid. The particularly preferred polymer is sodium polyacrylate. Other specific preferred polymers are the homopolymers and copolymers of maleic anhydride, especially the copolymers with ethylene, styrene and vinyl methyl ether.

Other film-forming polymers useful as binder materials include the cellulose esters such as carboxy methyl cellulose, hydroxyethyl cellulose, methyl cellulose and hydroxypropyl cellulose.

Examples of other binder materials include sorbitan fatty acid esters selected from the group consisting of sorbitan monolaurate, dilaurate, trilaurate, monopalmitate, monostearate, distearate, tristearate, monooleate, dioleate, and trioleate, are preferred. Ethoxylated varieties of these compounds are also useful. For example, sorbitan esters having an average total level of ethoxylation of from about 4 to about 100, and preferably about 20 to about 85 moles of ethylene oxide per mole of sorbitan, are preferred.

Also preferred binder materials include sorbitan monopalmitate, sorbitan monostearate, sorbitan distearate, and sorbitan tristearate. Polyethylene glycols having an average molecular weight of from about 4,000 to about 8,000 are also useful and preferred. A mixture of lauric acid:PEG 8,000, in a weight:weight ratio of about 2:1 to about 1:2, more preferably about 1:1, is also preferred.

If employed, the level of binder material useful within the particles of this invention is from about 5% to about 25% by weight of the particles, more preferably from about 10 to about 25% by weight of the particles.

The particles of the present invention may also contain all of the usual components of detergent compositions including the ingredients set forth in U.S. Pat. No. 3,963,537, Baskerville et al., incorporated herein by reference, so long as they are inert with respect to the bleach activator, surfactant, and binder material. Such components include other peroxygen bleach activators, builders, softeners, color speckles, suds boosters, suds suppressors, antitarnish and/or anticorrosion agents, soil-suspending agents, soil release agents, dyes, fillers, optical brighteners, germicides, alkalinity sources, hydrotropes, antioxidants, enzymes, enzyme stabilizing agents, perfumes, etc.

The bleach activator particles made by the present invention can be used with percarbonate or perborate as a laundry bleach additive, or can be included in a conventional granular laundry detergent composition together with various conventional detersive ingredients. Detergent compositions and bleaching compositions containing the particulate lactam bleach activators herein provide extremely effective and efficient surface bleaching of textiles whereby stains and/or soils are removed from the textiles. Such activators provide optimal surface bleaching performance with washing solutions wherein the pH of such solution is between about 8.5 and 10.5 and preferably between 9.5 and 10.5, in order to facilitate the perhydrolysis reaction. Preferred are particulate laundry detergent compositions which preferably comprise from about 0.5% to about 40% by weight, more preferably from about 1% to about 20% by weight, of the particles produced by the present process.

The following illustrates the syntheses of two of the preferred liquid activators used herein.

EXAMPLE I

Synthesis of Nonanoyl Caprolactam—To a two liter, three necked round bottomed flask equipped with a condenser, overhead stirrer and 250 ml addition funnel is charged 56.6 g (0.5 moles) caprolactam, 55.7 g (0.55 moles) triethylamine and 1 liter of dioxane; the resulting solution is heated to reflux (120° C.). A solution of 88.4 g (0.5 moles) nonanoyl chloride dissolved in 200 ml of dioxane is then added over 30 minutes, and the mixture is refluxed for a further 6 hours. The reaction mixture is then cooled, filtered, and the solvent removed by rotary evaporation to yield 120.5 g of the product as a dark oil. This crude product is then redissolved in diethyl ether, washed with 3.50 ml aliquots of water, dried over magnesium sulphate, and the solvent removed by rotary evaporation to yield 81.84 g (65% theoretical yield) of a product which is shown by NMR to be 90% pure, with the remaining material being nonanoic acid.

EXAMPLE II

Synthesis of Nonanoyl Valerolactam—To a 5 liter flask equipped with a condenser, argon sweep, addition funnel, and overhead stirrer is charged 2.5 moles valerolactam, 2.75 moles triethylamine and 2 liters toluene. The resulting solution is heated to reflux, and 2.5 moles on nonanoyl chloride is added over 1.5 hours. The mixture is refluxed for 6 hours with stirring. The reaction mixture is then cooled and filtered. The filtrate is concentrated under vacuum, and the resultant oil is distilled at 162 C. and approximately 1 mm Hg to yield 1.6 moles of nonanoyl valerolactam. NMR analysis shows the product to be greater than 95% pure. Analysis: $^1$H NMR (ppm)-0.9(t, 3H); 1.3(M, 10H); 1.6(M, 2H); 1.9(M, 4H), 2.6(M, 2H); 2.9(t, 2H); 3.7(M, 2H). IR(CM$^1$)-2927, 2857, 1697, 1461, 1377, 1291, 1197, 1161.

AQUEOUS PROCESS

In the aqueous process herein, the liquid lactam bleach activator is intimately combined with a surface active agent to aid in its solubility and to improve the rate of perhydrolysis by means of an intimate mixing device. Without this step, dissolution rates of the bleach activator particles have been found to be hindered, thus reducing overall performance in a machine or hand washing environment. The preferred ratio of bleach activator to surfactant is about 10:1. The preferred surfactant is selected from the group consisting of $C_{11-13}$ linear alkyl benzene sulfonate, $C_{12-16}$ alkyl sulfate, $C_{14}$–$C_{18}$ methyl ester sulfonates, or mixtures thereof. Importantly, the bleach activator is intimately mixed in the mixer with a preferred surfactant or surfactant mix (i.e., Mixing Step I). The output of this intimate mixer is a viscous paste. Preferably, the free water content in the viscous paste is less than about 15% by weight. The surfactant and bleach activator can be pumped and metered into the mixer together, or alternatively, the surfactant may be added sequentially about half way down its barrel apart from the activator. Optionally, a binder may be added to either stream. The surfactant and bleach activator are fed into the mixer at temperatures below the melting point of the bleach activator. The ratio of bleach activator to surfactant is typically 10:1 on an active basis. The output of the mixer is a viscous paste which, in a preferred process, comprises approximately 9% by weight of water and which is ~75% active.

While the mixer increases the temperature of the mixture (via kinetic energy input), the resulting temperature of the product increases ~1° C. (~2° F.) above the product feed temperature due to cooling water in the barrel jacket of the mixer. Care must be taken not to elevate the bleach activator temperature above the decomposition point of the bleach activator.

Once the activator/surfactant/thickener paste has been formed, the hydratable filler material is added, optionally with a binder. This can be done in another mixing device like a Lodige CB (i.e., Mixing Step II). The residence time in the mixer is critical in achieving the desired level of hydration while ensuring the mixer does not overmix and form oversized agglomerates. Note that it is not the intention in Step II to form particles meeting final product specifications. The contents in the mixer should never reach or exceed the melting point of the bleach activator or of the hydration temperature of the crystalline or non-crystalline filler material. To accomplish this mixing, both rotation speed and fill level should be properly controlled. The material discharged from the mixing device must have a free water level less than about 15% by weight (most desired less than about 8% by weight) for proper pre-particle formation characteristics.

That is, the product from the CB should have less than about 15% by weight of water for particle formation. In Particle Forming Step III, useful methods include use of an extruder, but most preferably an agglomerator. A Fuji-Paudal continuous extruder which forms the product from the CB into cylinders of approximately 1 mm in diameter (hole diameter of die plate) can be employed. In the preferred agglomeration process, a plough share mixer, such as a Lodige KM., is preferably used. The purpose of the agglomerator is to form the bleach activator mixture into defined particles which can be handled, shipped and finally blended into a detergent. Finished particles should exhibit acceptable physical characteristics such as attrition resistance, low surface area per unit volume for stability optimization, acceptable rate of solubility, good perhydrolysis, aesthetically appealing color and acceptable flow characteristics, i.e., non-sticky, non-friable, and free flowing. The following illustrates Steps I, II and III of the aqueous process in more detail.

Mixing Step I

The liquid acyl lactam bleach activator is intimately mixed with a surface active agent (aqueous, typically 50% to 90% surfactant:$H_2O$ paste) which aids in the lactam's solubility and improves its rate of perhydrolysis, through the use of a intimate mixing device. Without this step dissolution rates of the bleach activator particles have been found to be hindered, thus diminishing overall performance in a machine or hand washing environment. The preferred weight ratio of bleach activator to surfactant on an active basis is about 10:1 to about 1:1. The activator/surfactant paste is combined with a thickener and optionally a binder in solid form, as a hot melt, or in an aqueous mixture to re-establish a thickened workable paste of the liquid bleach activator/surfactant and which allows the mixture to be subsequently formed in Step III into free flowing, non-sticky particles with low friability. The paste will typically have a free moisture content of about 15% or lower.

The preferred mixing device is a Teledyne-Readco Processor (Readco mixer). The Readco is an intimate mixing device with variable residence time capabilities, typically less than about 1 minute, and is capable of handling viscous pastes. The Readco extruder/mixer is an axial, twin barrel processing device having various adjustable internal paddles. For use herein, these paddles may be configured in a number of ways to accomplish appropriate intimate mixing, defined herein as thoroughly homogenous physical mixing. Most useful combinations are double fiat paddles in series interspersed with helical paddles to force the bleach activator/surfactant/thickener paste mixture through the unit.

The most preferable lactam/surfactant/thickener mixing occurs between the stated bleach activators, surfactants which are linear alkylbenzene sulfonate, $C_{12-18}$ alkyl sulfate, $C_{14}$–$C_{18}$ methyl ester sulfonate, or mixtures thereof and a thickener which is a polyhydroxy fatty acid amide. The output of this mixture is a homogenous viscous paste. For optimal particle processing and handling, a binder is added in the Readco or in Step II—the Lodige CB.

Mixing Step II

Next, the activator/surfactant/thickener/optional binder paste is added into a Lodige CB mixer to which a hydratable filler material and optional binder are added to the paste mix from I. Examples of suitable hydratable filler materials are sodium sulfate, sodium acetate, sodium phosphate, sodium acid phosphite, lithium formate, lithium sulfate, zinc nitrate, sodium carbonate, zeolites and dehydrated zeolites, especially zeolite A, and mixtures thereof. Residence times are from about 30 seconds to about 1.5 minutes. The total moisture content of the mixture is from about 0 to about 15% by weight of water. The purpose of this step is to homogenize the activator/surfactant/thickener/filler/binder into a smooth, cohesive, wet, semi-particulate mass or damp powder (depending on the moisture content) which will be formed into agglomerates in Step III. The free moisture content at this stage is typically 15%, by weight, or less.

Particle Forming Step III

The preferred particle-forming device is an agglomerator such as a Lodige KM. The Lodige KM is a rotating plough share mixer typically used for particle agglomeration and formation. The activator/surfactant/thickener/filler/binder mix for Step III are formed into particles during a residence time of from about 5 to about 15 minutes in the KM. This residence time is critical to achieve a free water content of the final product of the process herein-most preferably less than about 8% by weight of free water. In the KM the agglomerates are formed which exhibit the desired characteristics such as attrition resistance, optimal particle size distribution, acceptable rate of solubility, efficient perhydrolysis, good storage stability, aesthetically appealing color and acceptable flow characteristics, i.e., a particle which is non-sticky, non-friable, and free-flowing. It is important that the contents in the KM mixer not reach the hydration temperature of the hydratable filler material to provide an opportunity to effectively reduce the free water in the semi-particulate mass and to enhance particle formation. It is convenient to run at 25° C. to 30° C. This is accomplished by carefully gauging the rotation speed and fill level of the mixer.

NON-AQUEOUS PROCESS

The following illustrates the non-aqueous process herein.

Mixing Step I

The liquid acyl lactam bleach activator is intimately mixed with a surface active agent (very low moisture content, typically greater than 90% to about 100% by weight surfactant) which aids the bleach activator solubility and improves its rate of perhydrolysis. Without this step, dissolution rates of the bleach activator particles have been found to be hindered, thus diminishing overall performance in a machine or hand washing environment. The preferred weight ratio of bleach activator to surfactant on an active basis is about 10:1 to about 1:1. The activator/surfactant paste may be further mixed with a thickener to re-establish a thickened workable paste of the liquid bleach activator/surfactant which allows the mixture to be subsequently formed into free flowing, non-friable, non-sticky particles in Step III.

The preferred mixing device is a Teledyne-Readco Continuous Processor (Readco mixer). The Readco mixer is an intimate mixing device with variable residence time capabilities, typically less than about 1 minute, and is capable of handling viscous pastes. The Readco mixer is an axial, twin barrel processing device having various adjustable internal paddles. For use herein, these paddles may be configured in a number of ways to accomplish appropriate intimate mixing, defined herein as thoroughly homogenous physical mixing. Most useful combinations are double fiat paddles in series interspersed with helical paddles to force the bleach activator/surfactant/thickener paste mixture through the unit.

The most preferable lactam/surfactant/thickener mixing occurs between the stated bleach activators and surfactants which are $C_{12}$ alkyl sulfate, palm stearine methyl ester sulfonate, and a thickening surfactant which is a polyhydroxy fatty acid amide, and mixtures thereof. The output of this mixture is a homogenous viscous paste. The free moisture content of the paste is typically less than about 5%, by weight. For optimal particle processing and handling, a binder is added in the Readco or in Step II-the Lodige CB.

Mixing Step II (Optional)

In this step, the .activator/surfactant/thickener/optional binder mix is added into a Lodige CB mixer to which an optional filler material and optional binder are also added. Examples of suitable filler materials are sodium aluminosilicate, finely divided clay, crystalline materials, and mixtures thereof. Residence times are from about 30 seconds to about 1.5 minutes. The total moisture content of the mixture is from about 0 to less than 5% by weight of water. The purpose of this step is to homogenize the activator/surfactant/thickener/filler/binder into an essentially moisture free mass which will be formed into particles in Step III. It is to be noted that Step I or II, or both, can conveniently be conducted at a temperature above the melting point of the thickener. The solidified product is then formed into particles in Step III.

Particle Forming Step III

The preferred particle-forming device is a Lodige KM. The Lodige KM is a rotating plough share mixer typically used for particle agglomeration and formation. The activator/surfactant/thickener/filler/binder mix from Step II is formed into particles during a residence time of from about 5 to about 15 minutes in the KM. In the KM the agglomerates are formed which exhibit desired characteristics such as attrition resistance, optimal particle size distribution, acceptable rate of solubility, efficient perhydrolysis, good storage stability, aesthetically appealing color and acceptable flow characteristics, i.e. a particle which is non-sticky and free-flowing with sufficient integrity for formulation purposes. In an alternate mode, Step III can comprise a process best described as chilling, flaking or grinding a molten mixture formed in Step I or II.

The following optional steps may be conducted using the products of either the aqueous or non-aqueous process herein.

Optional Step - Size Reduction

Preferred agglomerates herein range in size from about 200 micrometers to about 1200 micrometers, but other sizes can be manufactured, depending on the desires of the formulator. A COMIL basket type grinder may be used to size reduce agglomerated or extruded "overs" from the sizing operation. The output is blended with the "fines" resulting from the process and may be returned as process recycle Step I or II.

Optional Step - Coating Operation

Within the sizing operation a coating operation may be initiated to improve the flowability of the final particles. This will to ensure bleach activator agglomerates or extrudates can be bulk stored, shipped and unloaded with ease. The coating with conventional "free-flow" agents can be a dry coating such as a silica powder, fumed silica, or finely powdered zeolite that can be applied in a typical mix drum.

The following examples illustrate the compositions and processes of the present invention.

EXAMPLE III

Eighteen parts nonanoyl caprolactam is mixed with 9 parts $C_{12}$–$C_{15}$ polyhydroxy fatty acid amide by hand in a mortar and pestle to form a creamy paste. The mixture is placed in a Braun Food Processor, Multiprat 280, and 71 parts sodium aluminosilicate (approximately 80% active, 20% bound water) is added slowly forming an agglomerate. Following this, 2 parts AEROSIL 200 (fumed silica) is added to improve flow properties. The agglomerate is sized and is suitable for admixing into a granular detergent formulation.

EXAMPLE IV

Mixtures of iso-nonanoyl caprolactam (i—NCL, liquid acyl lactam bleach activator of interest), polyhydroxy fatty acid amide, methyl ester sulfonate, binder, filler (sodium alumino-silicate), and thickener (solid benzoyl caprolactam, PEG 8000, or polyhydroxy fatty acid amide) are prepared according to the formulation table below and co-melted to a temperature of about 160° F.–180° F. (71° C.–82° C.). The samples are then cooled to ambient laboratory temperature, whereupon all samples solidify.

All samples are hand granulated (broken, shaved, flaked or otherwise reduced into small particulates), added to a Braun Food Processor, Multiprac 280. A quantity of sodium alumino-silicate is added and mixed at medium speed for about 20 seconds to further improve the granulation. Optionally a small quantity of processing aid, AEROSIL 200, is added with mixing to improve granule flow properties. All sample agglomerates are suitable for admixing into a granular detergent formulation.

TEST PROCEDURE

A model detergent solution (containing water, alkylbenzene sulfonate surfactants, builders, pH approx. 10.5) is prepared at a concentration of 3,000 ppm. Seventy ml. detergent solution at about 80° F. (27° C.) is added to 100 ml beakers, and each of the sample agglomerates are added to the solution to form a concentration of nonanoyl caprolactam at 200 ppm. All sample agglomerates are observed to satisfactorily dissolve in the detergent solution within a few minutes with minimal agitation. No separation is observed, and no oily film forms on top of the solution.

| | Percentage of Formulation Component by Weight | | | | | | |
|---|---|---|---|---|---|---|---|
| Sample | i-NCL | Poly-hydroxy Fatty Acid Amide | PEG 8000 | $NaC_{16-18}$ MES | Sodium alumino-silicate | Aerosil 200 | Benzoyl Caprolactam |
| 105-A | 28 | 7 | 29 | 0 | 33 | 0.8 | 0 |
| 105-B | 16 | 8 | 41 | 0 | 16 | 1.5 | 16 |
| 105-C | 35 | 0 | 36 | 8 | 16 | 1.5 | 0 |

In addition to the foregoing, it can also be seen from FIG. 1 (where test conditions were somewhat different) that the overall activity of the bleach activator particles of the present invention can vary with the selection of surfactants and solid carriers used to form the particles. Thus, the most highly preferred particles herein will comprise a solid carrier and will further preferably comprise a mixture of surfactants comprising a polyhydroxy fatty acid amide (especially $C_{12}$–$C_{18}$, more preferably $C_{12}$–$C_{14}$, N-methylglucamide) and one or more surfactants selected from the group consisting of MES, AS, ethoxylated alcohols, and mixtures thereof.

The compositions herein are suitable for use in cold water, warm water and hot water, i.e., over the range of about 5° C. to the boil. The compositions may be used in machine-wash, soak and hand-wash compositions, typically at levels from 0.5% to 40%, and processes where bleaching is desired. The compositions herein are also useful in automatic dishwashing compositions with the so-called "per-bleaches" such as sodium perborate, sodium percarbonate, potassium persulfate, and the like.

What is claimed is:

1. An aqueous process for preparing a particulate bleach activator composition, comprising the steps of:

(I) intimately mixing from about 10% to about 70% by weight of a liquid lactam bleach activator selected from the group comprising hexanoyl caprolactam, hexanoyl valerolactam, octanoyl caprolactam, octanoyl valerolactam, nonanoyl caprolactam, nonanoyl valerolactam, isononanoyl caprolactam, isononanoyl valerolactam, decanoyl caprolactam, decanoyl valerolactam, undecanoyl caprolactam, undecanoyl valerolactam, 3,5,5-trimethylhexanoyl caprolactam, 3,5,5-trimethylhexanoyl valerolactam and mixtures thereof with from about 1% to about 60% by weight of a surfactant selected from the group consisting of non-amide surfactants, polyhydroxy fatty acid amide thickener surfactants, or mixtures thereof, and from about 5% to about 60% by weight of non-surfactant thickeners, to provide a thickened paste having a free moisture content less than 15%, by weight;

(II) homogenizing the paste of step I with from about 10% to about 85% by weight of a hydratable filler material to provide a semi-particulate mass or damp powder; and (III) forming the product of step II into agglomerates having a free moisture content less than about 8%, by weight, of water.

2. A process according to claim 1 wherein the surfactant is selected from the group consisting of sodium $C_{11}$–$C_{13}$ linear alkylbenzene sulfonates, $C_{12}$–$C_{16}$ alkyl sulfates, $C_{14}$–$C_{18}$ methyl ester sulfonates, $C_{10}$–$C_{18}$ polyethylene oxide condensates of alkyl moieties with an average of about 50 to 100 ethylene oxide groups, and mixtures thereof.

3. A process according to claim 1 wherein the thickener is selected from the group consisting of polyethylene glycols, magnesium compounds, polyvinyl-pyrrolidone, ethyl cellulose, sodium alumino-silicate, and solid acyl lactams.

4. A process according to claim 1 wherein the thickener surfactant is a $C_{12}$–$C_{18}$ N-methylglucamide.

5. A process according to the claim 1 wherein the filler material is selected from the group consisting of zeolite A, sodium carbonate, sodium sulfate, sodium acetate, sodium phosphate, sodium tripolyphosphate, sodium acid phosphite, lithium formate, lithium sulfate, zinc nitrate, sodium carbonate, zeolite A, and mixtures thereof.

6. A process according to claim 1 which additionally comprises the step of adding from about 5% to about 25% by weight of a binder material selected from the group consisting of polyethylene glycols, fatty acids, film forming polymers, nonionic surfactants and mixtures thereof in Step I or Step II.

7. A non-aqueous process for preparing a particulate bleach activator composition, comprising the steps of:

(I) intimately mixing from about 10% to about 70% by weight of a liquid lactam bleach activator selected from the group comprising hexanoyl caprolactam, hexanoyl valerolactam, octanoyl caprolactam, octanoyl valerolactam, nonanoyl caprolactam, nonanoyl valerolactam, isononanoyl caprolactam, isononanoyl valerolactam, decanoyl caprolactam, decanoyl valerolactam, undecanoyl caprolactam, undecanoyl valerolactam, 3,5,5-trimethylhexanoyl caprolactam, 3,5,5-trimethylhexanoyl valerolactam and mixtures thereof with from about 1% to about 60% by weight of a surfactant selected from the group consisting of non-amide surfactants, polyhydroxy fatty acid amide thickener surfactants, or mixtures thereof, and from about 5% to about 60% by weight of non-surfactant thickeners, to form a thickened paste having a moisture content less than about 5%, by weight;

(II) homogenizing the paste of step I with from about 10% to about 85% by weight of a filler material; and (III) forming the product of the foregoing into agglomerates having a free moisture content less than about 5%, by weight, of water.

8. A process according to claim 7 wherein the surfactant is selected from the group consisting of sodium $C_{11}$–$C_{13}$ linear alkylbenzene sulfonates, $C_{12}$–$C_{16}$ alkyl sulfates, $C_{14}$–$C_{18}$ methyl ester sulfonates, $C_{10}$–$C_{18}$ polyethylene oxide condensates of alkyl moieties with an average of about 50 to 100 ethylene oxide groups, and mixtures thereof.

9. A process according to claim 7 wherein the thickener is selected from the group consisting of polyethylene glycols, magnesium compounds, polyvinyl-pyrrolidone, ethyl cellulose, sodium alumino-silicate, and solid acyl lactams.

10. A process according to claim 7 wherein the thickener surfactant is a $C_{12}$–$C_{18}$ N-methylglucamide.

* * * * *

UNITED STATES PATENT AND TRADEMARK OFFICE

CERTIFICATE OF CORRECTION

PATENT NO. : 5,534,195

DATED : July 9, 1996

INVENTOR(S) : Chapman et al.

It is certified that error appears in the above-identified patent and that said Letters Patent is hereby corrected as shown below:

In Column 1, line 59, change "carder" to -- carrier --.

In Column 1, line 64, delete "lo".

In Column 3, line 6, change "nonamide" to -- non-amide --.

In Column 3, line 65, change "polyvinyl-pyrrolidone" to -- polyvinylpyrrolidone --.

In Column 4, line 55, change "octahoyl" to -- octanoyl --.

In Column 6, line 42, change "3,3,5-trimethylbenzoyl" to -- 3,4,5-trimethylbenzoyl --.

In Column 9, line 30, change "3-[methoxypolyethylene-oxy]propyl" to -- 3-[methoxypolyethyleneoxy]propyl --.

In Column 10, line 39, delete "to".

In Column 14, line 36, change "fiat" to -- flat --.

In Column 15, line 50, change "fiat" to -- flat --.

In Column 16, line 56, change "Multiprat" to -- Multiprac --.

In Column 18, line 43, change "polyvinyl-pyrrolidone" to -- polyvinylpyrrolidone --.

In Column 20, line 10, change "polyvinyl-pyrrolidone" to -- polyvinylpyrrolidone --.

Signed and Sealed this

Twenty-ninth Day of July, 1997

Bruce Lehman

*Attest:*

BRUCE LEHMAN

*Attesting Officer*

*Commissioner of Patents and Trademarks*